US005113532A

United States Patent [19]

Sutton

[11] Patent Number: 5,113,532

[45] Date of Patent: May 19, 1992

[54] METHOD OF MAKING GARMENT, GARMENT AND STRAND MATERIAL

[75] Inventor: Roger I. Sutton, Bermuda Run, N.C.

[73] Assignee: Golden Needles Knitting & Glove Co., Inc., Wilkesboro, N.C.

[21] Appl. No.: 668,812

[22] Filed: Mar. 8, 1991

Related U.S. Application Data

[63] Continuation of Ser. No. 285,402, Dec. 16, 1988, abandoned.

[51] Int. Cl.[5] ..... A41D 19/02

[52] U.S. Cl. ..... 2/167; 2/169; 2/2; 2/161 R

[58] Field of Search ..... 2/167, 2, 169, 159, 2/161 R, 2.5, DIG. 1, 243 A

[56] References Cited

U.S. PATENT DOCUMENTS

| | | | |
|---|---|---|---|
| 1,965,542 | 11/1933 | Colvin, Jr. | 139/425 R |
| 2,152,415 | 3/1939 | Kresselt | 66/174 |
| 2,335,644 | 11/1943 | Camp | 57/40 |
| 2,703,887 | 3/1955 | Kennedy | 2/167 |
| 2,779,025 | 1/1957 | Perry | 2/167 |
| 2,838,759 | 6/1958 | Tassie | 2/167 |
| 2,849,786 | 9/1958 | Ashley et al. | 28/80 |
| 3,490,224 | 1/1970 | Bourgeas | 57/140 |
| 3,871,946 | 3/1975 | Romanski et al. | 28/74 R |
| 3,934,062 | 1/1976 | Tillotson et al. | 2/167 X |
| 3,945,049 | 3/1976 | Barlow | 2/169 |
| 4,004,295 | 1/1977 | Byrnes, Sr. | 2/161 R |
| 4,089,069 | 5/1978 | Vistins | 2/161 R |
| 4,172,293 | 10/1979 | Vistins | 2/169 |
| 4,194,041 | 3/1980 | Gore et al. | 2/82 X |
| 4,321,854 | 3/1982 | Foote | 57/210 X |
| 4,382,301 | 5/1983 | Hightower, Jr. | 2/22 |
| 4,384,449 | 5/1983 | Byrnes, Sr. et al. | 2/161 R X |
| 4,413,391 | 11/1983 | Renjililan et al. | 28/166 |
| 4,463,156 | 7/1984 | McGary, Jr. et al. | 2/16 X |
| 4,470,251 | 9/1984 | Bettcher | 2/161 R X |
| 4,526,828 | 7/1985 | Fogt et al. | 2/16 X |
| 4,530,206 | 7/1985 | Benichou et al. | 57/250 |
| 4,640,179 | 2/1987 | Cameron | 57/210 X |
| 4,742,578 | 5/1988 | Seid | 2/2.5 |
| 4,750,339 | 6/1988 | Simpson | 2/162 X |
| 4,777,789 | 10/1988 | Kolmes et al. | 57/210 |
| 4,783,853 | 11/1988 | Zuber | 2/2 |
| 4,825,470 | 5/1989 | Horio | 2/21 |
| 4,833,733 | 5/1989 | Welch et al. | 2/169 |
| 4,838,017 | 6/1989 | Kolmes et al. | 57/210 |

FOREIGN PATENT DOCUMENTS

| | | | |
|---|---|---|---|
| 3023990 | 1/1982 | Fed. Rep. of Germany | 2/16 |
| 2250497 | 7/1975 | France | 66/202 |
| 51-40469 | 4/1976 | Japan | 66/202 |
| 1040469 | 4/1976 | Japan | 66/202 |
| 1583447 | 1/1981 | United Kingdom | 2/79 |
| 1583448 | 1/1981 | United Kingdom | 2/79 |

*Primary Examiner*—Werner H. Schroeder
*Assistant Examiner*—Sara M. Current
*Attorney, Agent, or Firm*—Spencer & Frank

[57] ABSTRACT

This invention relates to a method of making a protective garment, a garment produced in accordance with the method, and a strand material used in the method and garment. The strand material comprises cut resistant material such as KEVLAR, aramid, metallic, and combined KEVLAR and metallic strands, or the like, which are extrusion coated with vinyl, polyurethane or other suitable fluid impervious material. Coating the strands with fluid impervious material results in a cut resistant high strength fabric which is resistant to staining. The method comprises manipulating the strand material using substantially conventional textile fabric forming technology such as knitting to form a fabric and a garment, and may include coating the finished garment to achieve enhanced characteristics. One such characteristic which may be achieved is to make a garment fluid impervious, by coating a substrate with fluid impervious materials such as flexible urethane to protect the wearer. The garments may be in the form of gloves, sleeves, aprons and the like. Another characteristic is to make a garment, made of this material, puncture resistant, by applying a hard urethane coating to all, or part of a garment, which may be first made fluid impervious by applying a flexible fluid impervious coating.

20 Claims, 1 Drawing Sheet

METHOD OF MAKING GARMENT, GARMENT AND STRAND MATERIAL

This application is a continuation of application Ser. No. 07/285,402, filed Dec. 16, 1988 now abandoned.

FIELD AND BACKGROUND OF INVENTION

This invention relates to a method of making a protective garment, a garment produced in accordance with the method, and a strand material used in the method and garment.

Protective garments have been well known and widely used in a number of applications and fields. By way of example, protective garments in the form of gloves which are coated after manufacture are shown in Kennedy U.S. Pat. No. 2,703,887; Tassie U.S. Pat. No. 2,838,759; and Tillotson U.S. Pat. No. 3,934,062. By way of further example a penetration resistant glove first formed of synthetic rubber which has a fabric overlay in the palm and thumb areas affixed by adhesives is shown in Seid U.S. Pat. No. 4,742,578. The technology of making such gloves may as well be applied to the manufacture of other protective type garments.

While protective garments made as described in the aforementioned prior patents have achieved some success and acceptance, such garments have limitations in protecting wearers against injury from slashing and penetrating, while at the same time resisting staining. Cut resistant gloves are used in surgical and meat processing applications as well as other applications. Particularly in the meat processing environment, blood and animal fat stains gloves and reduces their useful life. A further consideration that has more recently arisen is to create protective garments, such as gloves, which are cut and stain resistant and impervious to fluids. For this reason, enhancement of the cut resistance of a protective garment is a constantly sought goal.

In clean room environments there is the need to provide protective clothing, particularly gloves which are conductive. Gloves which are nonconductive and stain resistant can be made of various materials. However, gloves so made do not have the property of being cut resistant. And in turn, garments, such as gloves, which are made of cut resistant fibers which are nonconductive have not had the property of being resistant to discoloration.

At present, the technology teaches forming a garment such as a glove and affixing protective material such as a fiber fabric or creating a garment from a fabric and coating it with a substance such as latex. Present technology does not teach a single strand based garment where the fabric is made from one strand having the property of cut and discoloration resistance.

Attempts to produce cut resistant fabrics from steel wire and KEVLAR strands, have been unsuccessful because the strands either break in the fabric forming machines or cause breakage of the machines. As a consequence other techniques for manufacturing garments with the desired properties of cut and discoloration resistance have met with limited success.

BRIEF DESCRIPTION OF INVENTION

With the forgoing particularly in mind, it is an object of this invention to provide a protective garment having cut resistance. In realizing this object of this invention, a protective garment is made in which the garment consists essentially entirely of high strength strands, which can be made of KEVLAR, steel, aramid, and combined KEVLAR and stainless steel strands, or other suitable materials, on which there is applied an extrusion coating of vinyl or polyurethane, or other suitable fluid impervious materials.

A further object of this invention is to manufacture a protective garment of the type described by processes which follow essentially conventional textile manufacturing processes. The process of extrusion coating a high strength fiber with a material such as polyurethane or vinyl results in a strand which is suitable for manipulation in accordance with conventional textile manufacturing processes to create fabrics.

Yet a further object of this invention is to provide a strand material which, when it is made into a fabric, has the characteristic of being resistant to discoloration.

Yet another object is to provide a cut resistant strand which can be manipulate into a fabric by conventional textile manufacturing techniques, the resulting fabric being suitable for the disposition of a fluid impervious material to create a garment both cut resistant and fluid proof. Further treatment of the fabric with hard polyurethane will render it puncture proof as well.

BRIEF DESCRIPTION OF DRAWINGS

Some of the objects of the invention having been stated, other objects will appear as the description proceeds, when taken in connection with the accompanying drawings, in which.

DETAILED DESCRIPTION OF THE INVENTION

While the present invention will be described more fully hereinafter with reference to the accompanying drawings, in which a preferred embodiment of the present invention is shown, it is understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not limiting upon the present invention.

Figure 1:
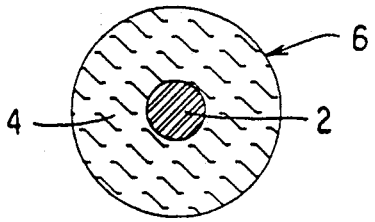
FIG. 1 is a cross section view of a strand material in accordance with this invention.
Figure 2:
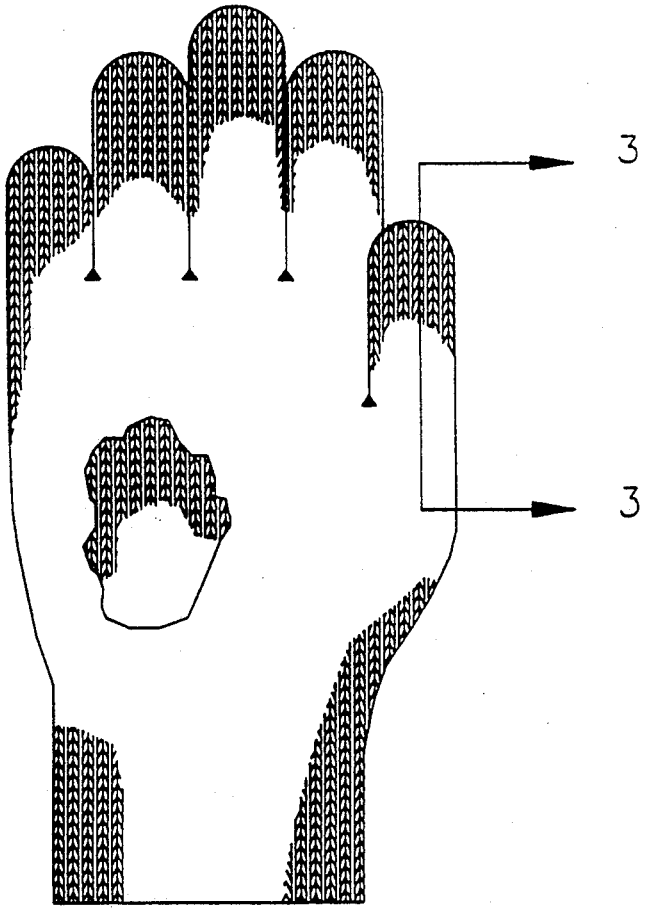
FIG. 2 is an elevation view, partly broken away, of a protective garment as contemplated by the invention and made using the strand material of FIG. 1.

Referring now more particularly to the accompanying drawings, a protective garment in accordance with this invention is there shown in FIG. 2. The garment (in the illustrated case, a glove) is made using a strand material as using a strand material 6 as in FIG. 1. The method of making the garment is essentially based upon conventional textile techniques.

The core 2 of the strand material 6, is a high strength cut resistant material. Although various materials may be used, it is contemplated that for the purposes of this disclosure the high strength cut resistant material 2 may be KEVLAR, aramid strands, stainless steel strands, or a combination of KEVLAR and stainless steel strands. High strength cut resistant material 2 of this type construction is resistant to cutting or abrasion, which may be experienced in the use of garments, such as gloves, worn in environments such as meat processing, surgical procedures and electronic clean room environments.

High strength high strength cut resistant material 2 is extrusion coated with a fluid impermeable coating 4 which for the purposes of this disclosure may be vinyl or polyurethane. Other suitable fluid impervious materials may be used. The resulting strand material 6 has the characteristic of being resistant to cutting as well as resistant to discoloration. Furthermore, the composite strand material 6 can be made in smaller denier. It has been found by the inventor that smaller denier strands formed as disclosed can be made into fabric suitable for protective garments manufactured using conventional textile manufacturing techniques. The resulting smaller denier strands do not break when it is in knitting machines nor does the strand cause damage to the machinery. The size strands which have been successfully knit are from 2400 down to 55 denier.

A significant element of the present invention lies in the fact that the composite strand material 6 may be fabricated into a garment, and particularly a glove as illustrated, by knitting the strand material 6 into a fabric. In the instance of a glove or arm shield, the strand material 6 is knit into a tubular fabric using either a circular knitting machine or a glove knitting machine of known types. Stitch sizes in such machines may, for example only, be in the range of 7 to 20 cut. Without the extrusion applied coating, the underlying high strength cut resistant material 2 would not be susceptible to the manipulation necessary in a knitting machine.

As will become clear from the discussion above, use of the extruded strand material 6 of this invention enables the fabrication of protective garments using conventional textile techniques such as knitting. Such a garment preferably takes the form of a glove, as illustrated at FIG. 2. However, it is contemplated that the garment may take other forms, including without limitation arm shields, aprons and the like. In all such instances, the protective garment contemplated by this invention will comprise, at a point during its manufacture, a body of a strand material 6 formed by a monofilament or a multifilament bundle of continuous high strength strands 2 formed from KEVLAR, aramid, stainless steel and combined KEVLAR/stainless steel strands extrusion coated with vinyl or other suitable fluid with vinyl or polyurethane, or other suitable fluid impervious material 4. For gloves and certain other products, the strand material is knit into loops forming courses and wales.

The protective garments have a range of applications. Protective garments used in meat processing environments are subject to discoloration from blood and fats. Garments made in accordance with this invention are capable of resisting discoloration and are therefore usable for a longer duration of time. Another application derives from the electrically conductive nature of the stainless steel and stainless steel/KEVLAR component. Due to the electrically conductive nature, garments made in accordance with this invention are capable of conducting static electrical charges while avoiding damage to static sensitive components or sparking with uncontrolled discharge of static electricity. This is important in the manufacture of microelectronic elements and in operating rooms or other explosive atmospheres. Another derives from the resistance of the fabric to cutting with sharp edged instruments such as knives or scaples. Such cut resistance can be of substantial significance in such diverse environments as operating rooms and meat processing plants.

Figure 3:
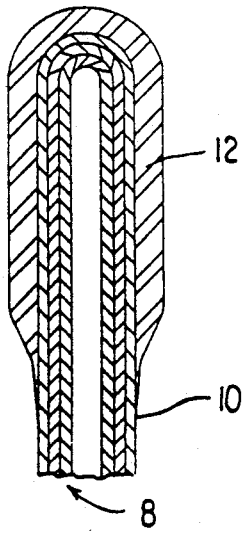
FIG. 3 is a section view, taken generally along the line 3—3 in FIG. 2, showing a modified form of the protective garment of FIG. 2.

The present invention contemplates that the protective characteristics of the garments of this invention may be enhanced for certain applications by coating of the fabric of a garment after fabrication of the fabric. Such a modified form is indicated in FIG. 3, a section view taken as if along the line 3—3 in FIG. 1, yet illustrating a form of the invention different from that of FIG. 2. In the modified form, the method of manufacturing the garment further comprises the step of applying to a fabricated product 8 a coating of a fluid impermeable material 10 and/or a coating of a puncture resistant material 12. In the specific form illustrated, both coatings are applied, with a fluid impermeable coating 10 being first applied and then a puncture resistant coating 12 being applied on the fluid impermeable coating 10. In a preferred form, the fluid impermeable coating 10 is a flexible urethane. In such a form, the puncture resistant coating 12 is a hard urethane. Where both are applied, as for a surgical glove, the flexible, fluid impermeable coating 10 provides a resilient underlayer for the hard, puncture resistant coating 12 and enhances the ability of the harder layer 12 to resist puncture by causing the layers to act as a trampoline. As will be understood, these characteristics enhance the ability of the garment 8 to protect against skin penetration by a suture needle or the like used in surgery. Such skin penetration, as will be appreciated, exposes medical personnel to increased risk of infection. Particularly for a surgical glove, it is preferred that the coating of a fluid impermeable material 10 cover at least a major portion of the body of strand material, while the coating of the puncture resistant material 12 covers at least a minor portion of the body of strand material (garment) 8 such as the finger tips where puncture wounds are more likely.

In the drawings and specifications there has been set forth a preferred embodiment of the invention and, although specific terms are used, the description thus given uses terminology in a generic and descriptive sense only and not for purposes of limitation.

I claim:

1. A method of making a protective garment comprising the steps of:

providing a strand material by extrusion coating a cut resistant core material with a fluid impervious and stain resistant material, wherein said strand material is cut resistant and stain resistant and fluid impervious; and manipulating the resulting strand material into a fabric from which a garment is made.

2. A method according to claim 1 wherein said step of manipulating the resulting strand material comprises knitting the strand material into a garment.

3. A method according to claim 1 wherein said step of manipulating the resulting strand material comprises knitting the strand material into a tubular fabric.

4. A method according to claim 1 wherein said step of manipulating the resulting strand material comprises knitting the strand material into a glove.

5. A method according to claim 1 further comprising the step of applying to a fabricated garment a coating of puncture resistant material.

6. A method according to claim 1 further comprising the step of applying to a fabricated garment a coating of fluid impermeable, flexible urethane.

7. A method according to claim 1 further comprising the step of applying to a fabricated garment a coating of puncture resistant, hard urethane.

8. A method according to claim 1, further comprising the steps of first applying to a fabricated garment a coating of fluid impermeable, flexible urethane and second applying a coating of puncture resistant, hard urethane over said first coating.

9. A method according to claim 1 wherein said cut resistant core material is a cut resistant strand.

10. A method according to claim 9 wherein said cut resistant strand is selected from the group consisting of KEVLAR, aramid, stainless steel, and a combination stainless steel and KEVLAR.

11. A method according to claim 9 wherein said cut resistant strand is 55 denier KEVLAR.

12. The method according to claim 1, wherein said garment is a glove.

13. A protective garment comprising a textile fabric comprising a body of strand material formed by extrusion coating a cut resistant core material with a fluid impervious and stain resistant material, wherein said strand material is cut resistant and stain resistant and fluid impervious.

14. A protective garment according to claim 13 wherein said cut resistant core material comprises a cut resistant strand selected from the group consisting of KEVLAR, aramid, stainless steel and a combination stainless steel and KEVLAR, and said fluid impervious and stain resistant material is selected from the group consisting of vinyl and polyurethane.

15. A protective garment according to claim 13 wherein said strand material is knit into loops forming courses and wales.

16. A garment according to one of claim 14 or 15 in the form of a glove.

17. A glove according to claim 16 wherein said textile fabric further comprises a coating of fluid impermeable material that covers at least a major portion of the glove.

18. A glove according to claim 16 wherein said textile fabric further comprises a coating of puncture resistant material that covers at least a major portion of the glove.

19. A glove according to claim 16 wherein said textile fabric further comprises a coating of fluid impermeable material that covers at least a major portion of the glove and a coating of a puncture resistant material that covers at least a minor portion of the glove.

20. A protective garment according to claim 13 wherein said cut resistant core material comprises a cut resistant strand of 55 denier KEVLAR.

* * * * *